US007819705B2

(12) United States Patent
Akama

(10) Patent No.: US 7,819,705 B2
(45) Date of Patent: Oct. 26, 2010

(54) CONTACT MEMBER AND CONNECTOR INCLUDING THE CONTACT MEMBER

(75) Inventor: Junichi Akama, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 19 days.

(21) Appl. No.: 12/491,294

(22) Filed: Jun. 25, 2009

(65) Prior Publication Data

US 2010/0173536 A1 Jul. 8, 2010

(30) Foreign Application Priority Data

Jan. 8, 2009 (JP) ..... 2009-002565

(51) Int. Cl.
*H01R 13/432* (2006.01)

(52) U.S. Cl. ..... 439/746; 439/66; 439/908; 439/591

(58) Field of Classification Search ..... 439/746, 439/733.1, 869, 871, 66, 908, 591
See application file for complete search history.

(56) References Cited

U.S. PATENT DOCUMENTS 7,559,771 B2 * 7/2009 Akama et al. ..... 439/66
2005/0088193 A1 4/2005 Haga

FOREIGN PATENT DOCUMENTS

JP 56-8837 A 1/1981
JP 2001-235486 A 8/2001
JP 2005-129428 A 5/2005

* cited by examiner

*Primary Examiner*—Tho D Ta
*Assistant Examiner*—Travis Chambers
(74) *Attorney, Agent, or Firm*—IPUSA, PLLC

(57) ABSTRACT

A contact member includes a body part formed by providing a belt-shaped part in a substantially ring shape; an internal circumferential side contact part provided at one end of the body part and situated at an internal circumferential side of the contact member; and an external circumferential side contact part provided at another end of the body part and situated at an external circumferential side of the contact member.

9 Claims, 16 Drawing Sheets

RELATED
ART (A)

CONTACT MEMBER AND CONNECTOR INCLUDING THE CONTACT MEMBER

CROSS-REFERENCE TO RELATED APPLICATIONS

This patent application is based upon and claims the benefit of priority of Japanese Patent Application No. 2009-002565 filed on Jan. 8, 2009, the entire contents of which are incorporated herein by reference.

BACKGROUND OF THE INVENTION

1. Field of the Invention

The present invention generally relates to contact members and connectors including the contact members. More specifically, the present invention relates to a contact member used when an LGA type or a BGA type IC package is mounted on a circuit board and a connector including the contact member.

2. Description of the Related Art

Integrated Circuit (IC) package connectors have been used in order to mount LGA (Land Grid Array) type or BGA (Ball Grid Array) type IC packages on circuit boards where the LGA type or BGA type IC packages can be easily exchanged. Recently, high reliability, large amounts, and high speed of data transmission have been required for such IC package connectors.

As transmission speed of data becomes higher, it is necessary to consider the influence of inductance of contacts. In recent years, the transmission speeds of the data are of GHz order of magnitude. In order to properly transmit the data, it is required that the inductance of the contacts of the IC package connector be of nanohenry (nH) order of magnitude.

In addition, the contact is required to have a structure where an elastic force is generated when the contact is used. Furthermore, it is also required that the size of the contact be small so that the contact can correspond to pitches of pads of the IC package.

FIGS. 1(A) and 1(B) are views showing an example of a related art contact member. More specifically, FIG. 1(A) is a top view and FIG. 1(B) is a side view.

As shown in FIGS. 1(A) and 1(B), a contact member 1 has a structure of a helical spiral spring having plural turns. See, for example, Japanese Patent Application Publications No. 56-8837, No. 2001-235486, and No. 2005-129428. The contact member 1 is used where the contact member 1 is compressed in an axial direction so that a repulsion force is generated. The transmission path of an electrical signal is helical.

Although the contact member 1 shown in FIGS. 1(A) and 1(B) has an elastic force, inductance of the contact member 1 is not small because the transmission path of the electrical signal is helical. Accordingly, the contact member 1 shown in FIGS. 1(A) and 1(B) may not be proper for high speed data transmission.

In addition, the size of the contact member 1 shown in FIGS. 1(A) and 1(B) is not small. Hence, the contact member 1 may not be proper as a contact member of, for example, an IC package connector which is required to be arranged with a short pitch.

SUMMARY OF THE INVENTION

Accordingly, embodiments of the present invention may provide a novel and useful contact member and connector including the contact member solving one or more of the problems discussed above.

More specifically, the embodiments of the present invention may provide a contact member having good elasticity and being capable of reducing inductance, the contact member being capable of being arranged with a short pitch, and a connector including the contact member.

Another aspect of the present invention may be to provide a contact member, including a body part formed by providing a belt-shaped part in a substantially ring shape;

an internal circumferential side contact part provided at one end of the body part and situated at an internal circumferential side of the contact member; and an external circumferential side contact part provided at another end of the body part and situated at an external circumferential side of the contact member;

wherein, in a case where the body part is compressed in an axial direction, the body part is elastically deformed so that the internal circumferential side contact part and the external circumferential side contact part come in contact with each other, the belt-shaped part includes a U-shaped turning point between the internal circumferential side contact part and the external circumferential side contact part; and one of the internal circumferential side contact part and the external circumferential side contact part includes a first projecting part, the first projecting part being configured to come in contact with the other of the internal circumferential side contact part and the external circumferential side contact part.

Another aspect of the present invention may be to provide a connector, including the contact member as claimed in claim 1; and a connector main body having a hole part corresponding to the body part, wherein the body part is movably supported by the hole part in an axial direction of the body part after the body part is inserted in the hole part.

According to the embodiments of the present invention, it is possible to provide a contact member having good elasticity and being capable of reducing inductance, the contact member being capable of being arranged with a short pitch, and a connector including the contact member.

Additional objects and advantages of the embodiments are set forth in part in the description which follows, and in part will become obvious from the description, or may be learned by practice of the invention. The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

A description is given below, with reference to the FIG. 2(A) through FIG. 16(B) of embodiments of the present invention.

First Embodiment

FIGS. 2(A)-2(C) are views showing a contact member of the first embodiment of the present invention. FIG. 2(A) is a side view, FIG. 2(B) is a top view, and FIG. 2(C) is a front view. FIGS. 3(A)-3(C) are views showing a compressed state where a contact member 10A is compressed in an axial direction. FIG. 3(A) is a side view, FIG. 3(B) is a top view, and FIG. 3(C) is a front view. FIGS. 2(A)-2(C) show the contact member 10A before being used. FIGS. 3(A)-3(C) show the contact member 10A after being used.

The contact member 10A has a substantially rectangular pole-shaped configuration and an extremely small size. An internal diameter D0 of the contact member 10A is approximately 0.5 mm. A length H0 in an axial direction is approximately 1.5 mm.

Figure 4:
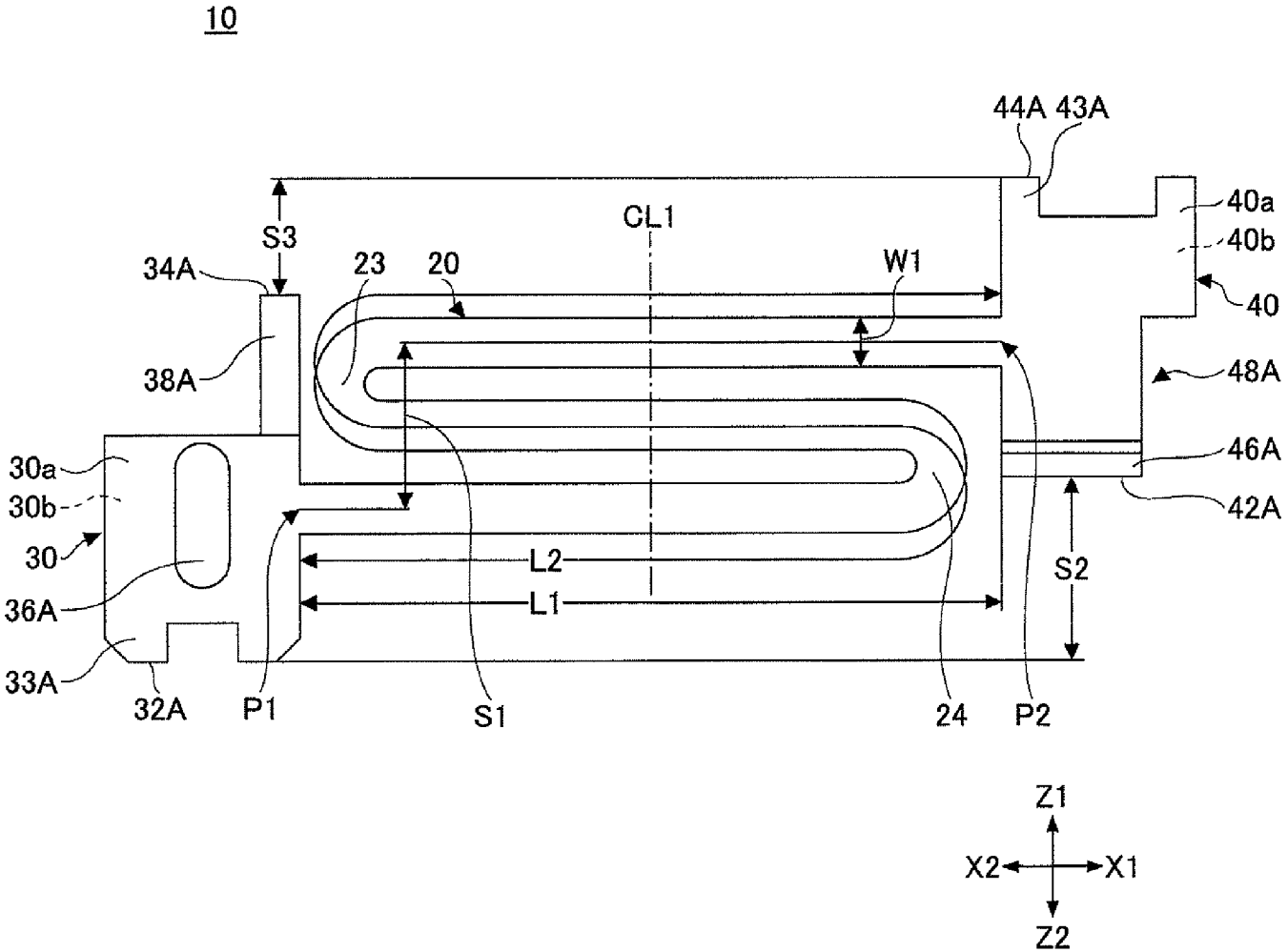
FIG. 4 is a developed view of the contact member 10A.

FIG. 4 is a developed view of the contact member 10A. In other words, FIG. 4 is a view showing a (to be) developed plate member 10 before the developed plate member 10 is processed.

The developed plate member 10 is made by punching a plate having a thickness "t" of approximately 0.05 mm with a press so as to have a designated configuration. The developed plate member 10 is made of phosphor bronze or stainless steel. The developed plate member 10 has an external configuration where a horizontal side which is in X1-X2 directions is long so that the developed plate member 10 can be received in a rectangular shape. Vertical directions are Z1-Z2 directions.

The developed plate member 10 includes a belt-shaped part 20, an internal circumferential side contact part expected forming part 30, and an external circumferential side contact part expected forming part 40.

The belt-shaped part 20 forms a body part 20A described below. The internal circumferential side contact part expected forming part 30 is provided at an end of the X2 side of the belt-shaped part 20. The internal circumferential side contact part expected forming part 30 is configured to form an internal circumferential side contact part 30A discussed below. The external circumferential side contact part expected forming part 40 is provided at an end of the X1 side of the belt-shaped part 20. The external circumferential side contact part expected forming part 40 is configured to form an external circumferential side contact part 40A discussed below.

The belt-shaped part 20 having a width W1 has a substantially S-shaped configuration. The belt-shaped part 20 includes turning points 23 and 24. The belt-shaped part 20 is dissymmetric (bilaterally symmetric) with respect to a center line CL1 between the internal circumferential side contact part expected forming part 30 and the external circumferential side contact part expected forming part 40. The overall length L2 of the belt-shaped part 20 is approximately three times the length L1 between the internal circumferential side contact part expected forming part 30 and the external circumferential side contact part expected forming part 40.

One end of the belt-shaped part 20 is connected to the internal circumferential side contact part expected forming part 30 at P1 shown in FIG. 4. Another end of the belt-shaped part 20 is connected to the external circumferential side contact part expected forming part 40 at P2 shown in FIG. 4. P1 and P2 are shifted apart at a length S1 in a vertical direction.

The internal circumferential side contact part expected forming part 30 and the external circumferential side contact part expected forming part 40 are shifted apart in the vertical direction.

A lower end (end at a Z2 side) 32A of the internal circumferential side contact part expected forming part 30 projects in the Z2 direction at distance S2 from a lower end (end at a Z2 side) 42A of the internal circumferential side contact part expected forming part 40, so that a bifurcated (Y-bent shaped) contact part 33A is formed. Each head end of the bifurcated (Y-bent shaped) contact part 33A can be elastically deformed independently.

An upper end (end at a Z1 side) 44A of the external circumferential side contact part expected forming part 40 projects in the Z1 direction at distance S3 from an upper end (end at a Z1 side) 34A of the external circumferential side contact part expected forming part 30, so that a bifurcated (Y-bent shaped) contact part 43A is formed. Each head end of the bifurcated (Y-bent shaped) contact part 43A can be elastically deformed independently.

Front surfaces 30*a* and 40*a* are internal circumferential surfaces when the developed plate member 10 is formed into a pole (cylindrical) shape. Rear surfaces 30*b* and 40*b* are external circumferential surfaces when the developed plate member 10 is formed into the pole (cylindrical) shape.

In the external circumferential side contact part expected forming part 40, a first projecting part 46A is formed so as to project to the front surface (internal circumferential surface) 40*a*. The first projecting part 46A is formed by, for example, bending up a lower part of the external circumferential side contact part expected forming part 40.

In the internal circumferential side contact part expected forming part 30, a second projecting part 36A is formed so as to project to the rear surface (external circumferential surface) 30*b*. The second projecting part 36A is formed by, for example, applying a plasticity process to a part of the internal circumferential side contact part expected forming part 30.

A projection part 38A is provided at the rear surface (external circumferential surface) 30*b* of the internal circumferential side contact part expected forming part 30 so as to project in the Z1 direction. The projection part 38A is formed by, for example, bending up an upper part of the internal circumferential side contact part expected forming part 30. When the projection part 38A is pressed, the projection part 38A is elastically bent.

A notch part 48A corresponding to the projection part 38A is provided at the external circumferential side contact part expected forming part 40.

The contact member 10A having a substantially rectangular-shaped configuration is formed by winding the developed plate member 10 approximately 1.3 turns so that the internal circumferential side contact part expected forming part 30 and the external circumferential side contact part expected forming part 40 are overlapped in a circumferential direction.

Figure 1:
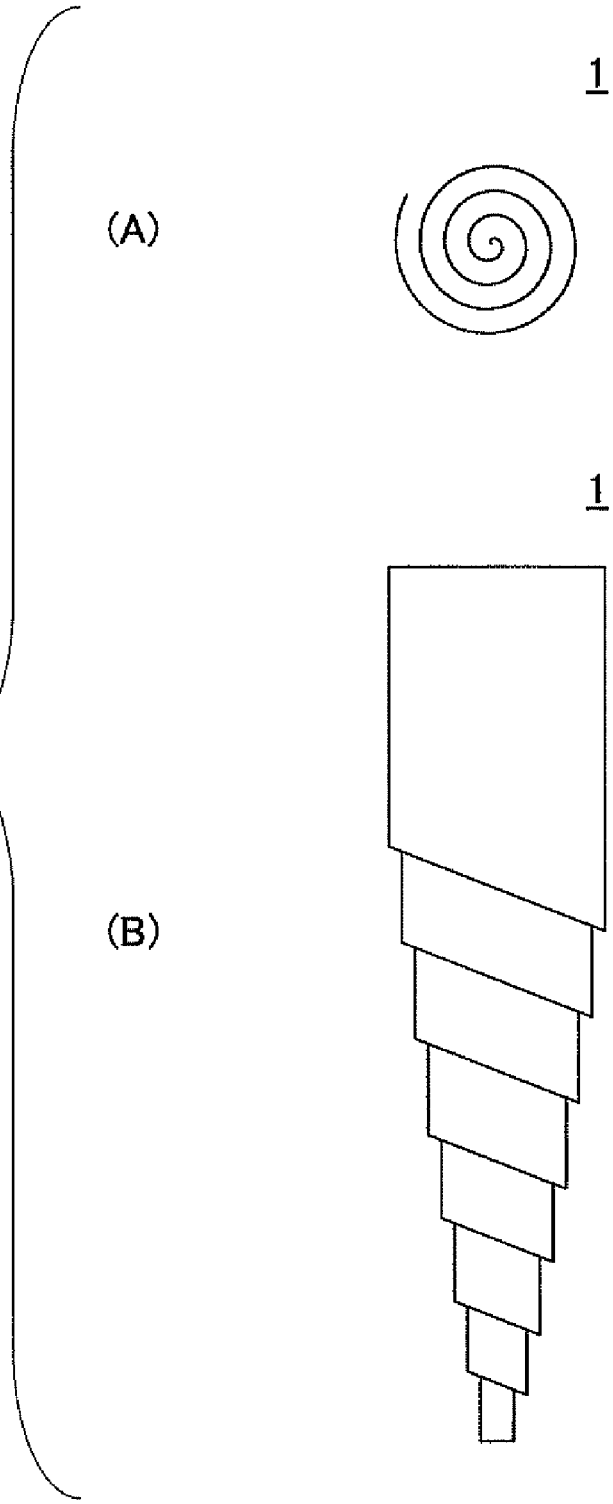
FIG. 1 is a view showing an example of a related art contact member.
Figure 2:
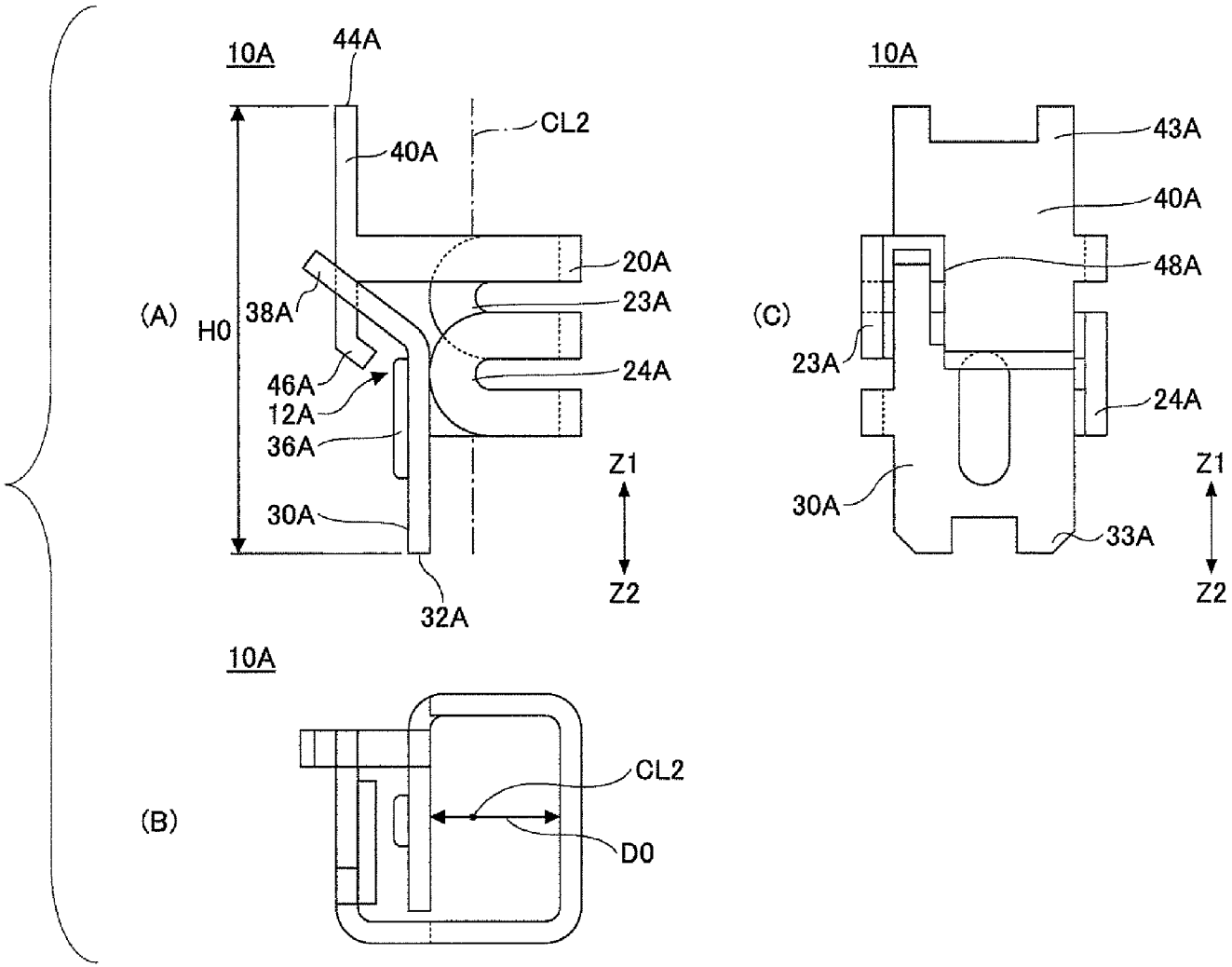
FIG. 2 is a view showing a contact member of a first embodiment of the present invention.

As shown in FIG. 2, the contact member 10A has the substantially square pole-shaped configuration. The contact member 10A includes the body part 20A, the internal circumferential side contact part 30A, and the external circumferential side contact part 40A.

The body part 20A is formed in a substantially ring shape by winding the belt-shaped part 20 substantially one turn. The internal circumferential side contact part 30A is provided at one end of the body part 20A. The external circumferential side contact part 40A is provided at another end of the body part 20A. The line CL2 indicated in FIG. 2 is an axial center line of the body part 20A.

The body part 20A includes turning points 23A and 24A between the internal circumferential side contact part 30A and the external circumferential side contact part 40A. The turning points 23A and 24A are arranged symmetrically with respect to a line (see FIG. 2(B)) indicating an internal diameter D0 in a direction where the internal circumferential side contact part 30A and the external circumferential side contact part 40A are overlapped, the line passing through a center of the body part 20A.

The internal circumferential side contact part 30A and the external circumferential side contact part 40A have plate-shaped configurations. The internal circumferential side contact part 30A is provided at the internal circumferential side and the external circumferential side contact part 40A is provided at the external circumferential side.

The second projecting part 36A is formed at the internal circumferential side contact part 30A so as to project to the external circumferential surface. The first projecting part 46A is formed at the external circumferential side contact part 40A so as to project to the internal circumferential surface. The second projecting part 36A and the first projecting part 46A face each other separated by a narrow gap 12A which is, for example, approximately 0.05 mm.

The internal circumferential side contact part 30A and the external circumferential side contact part 40A are shifted in the axial line CL2 direction (axial direction) so that the internal circumferential side contact part 30A is situated at the Z2 side and the external circumferential side contact part 40A is situated at the Z1 side.

The lower end 32A of the internal circumferential side contact part 30A projects in the Z2 direction more than the lower end 42A of the external circumferential side contact part 40A does.

The upper end 44A of the external circumferential side contact part 40A projects in the Z1 direction more than the upper end 34A of the internal circumferential side contact part 30A does.

Figure 3:
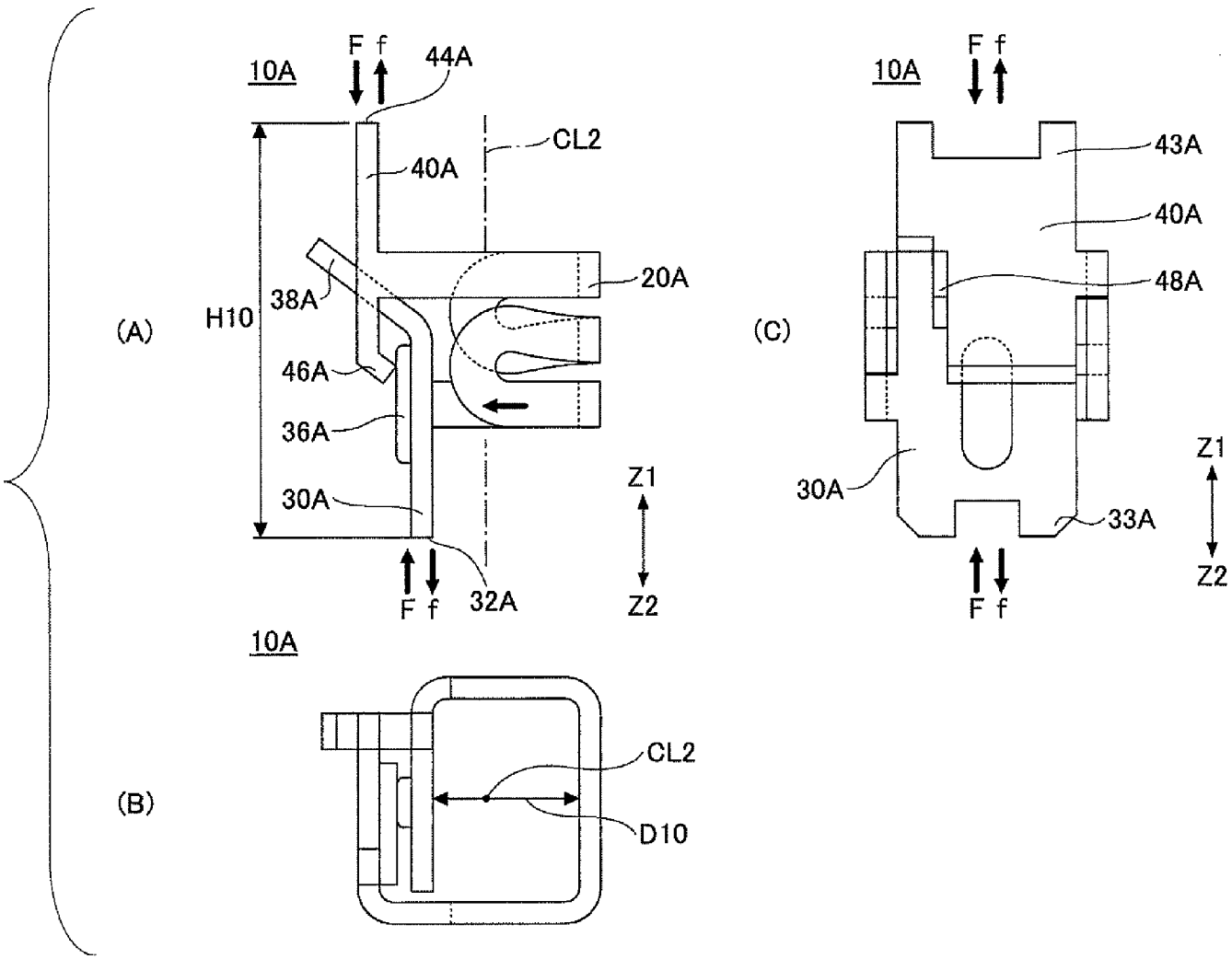
FIG. 3 is a view showing a compressed state where a contact member 10A is compressed in an axial direction.

Next, a modified state is discussed in which a pressing force (thrust force) F is applied so that the contact member 10A is compressed in the axial direction (Z1-Z2 directions) as shown in FIG. 3. In other words, a modified state is discussed in which pressing in the axial directions (Z1-Z2 directions) is applied so that the internal circumferential side contact part 30A and the external circumferential side contact part 40A approach each other.

When the pressing force F is applied to the contact member 10A, the body part 20A is elastically deformed in a direction where the length in the axial directions (Z1-Z2 directions) is shortened. In this compressed state, a repulsion force (resilience force) "f" for returning the elastic deformation to the original state is generated.

Figure 5:
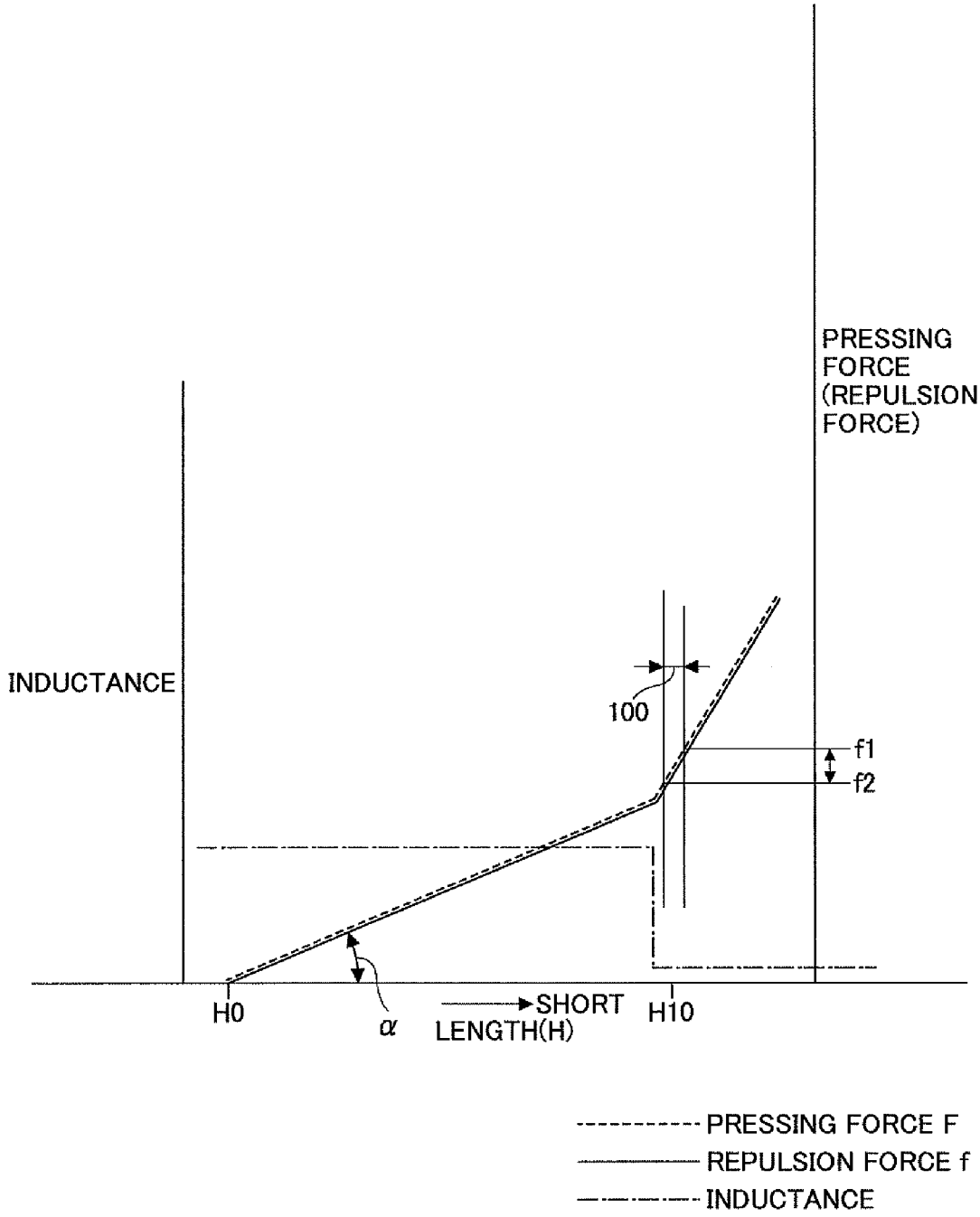
FIG. 5 is a graph showing properties of the contact member 10A.

FIG. 5 is a graph showing properties of the contact member 10A.

The relationship between the length H in the axial direction of the contact member 10A and the pressing force F is indicated by a dotted line in FIG. 5. The relationship between the length H in the axial direction of the contact member 10A and the repulsion force f is indicated by a solid line in FIG. 5. As shown in FIG. 5, as the length H is shorter, the pressing force F and the repulsion force f are increased proportionally at an angle $\alpha$. The angle $\alpha$ corresponds to a spring constant of the contact member 10A. Although the dotted line should be actually overlapped with the solid line, the dotted line and the solid line are indicated with a shift in FIG. 5 for the convenience of displaying the graph.

As the contact member 10A is modified in a direction where the length H is shortened, the body part 20A is elastically deformed in a direction where the internal diameter D is expanded and the internal circumferential side contact part 30A is moved in a direction approaching the external circumferential side contact part 40A.

As discussed above, the turning points 23A and 24A are arranged symmetrically with respect to a line (see FIG. 2(B)) indicating an internal diameter D0 in a direction where the internal circumferential side contact part 30A and the external circumferential side contact part 40A are overlapped, the line passing through a center of the body part 20A. Therefore, the body part 20A is elastically deformed evenly at the perimeter.

Hence, the internal circumferential side contact part 30A does not lean in a direction different from a direction approaching the external circumferential side contact part 40A. Because of this, the internal circumferential side contact part 30A properly approaches the external circumferential side contact part 40A.

When the length H of the contact member 10A becomes short so as to become H10, the internal diameter of the body part 20A becomes D10 as shown in FIG. 3. As a result of this, the external circumferential surface of the internal circumferential side contact part 30A comes in contact with the internal circumferential surface of the external circumferential side contact part 40A. When the internal circumferential side contact part 30A comes in contact with the external circumferential side contact part 40A, the body part 20A is eliminated from the electrical signal transmission path. As a result of this, the internal circumferential side contact part 30A and the external circumferential side contact part 40A, which are arranged in the Z directions in a contact state where the internal circumferential side contact part 30A and the external circumferential side contact part 40A come in contact with each other and are overlapped, become a straight line electrical signal transmission path. Therefore, a shortest electrical signal transmission path is formed and the inductance of the electrical signal transmission path is drastically reduced and becomes in the nanohenry (nH) order of magnitude as indicated by a one-dotted line in FIG. 5.

When the internal circumferential side contact part 30A comes in contact with the external circumferential side contact part 40A, friction is produced so that the pressing force F and the repulsion force f are drastically increased as indicated in FIG. 5.

In FIG. 5 a portion indicated by a numerical reference 100 is a region just after the internal circumferential side contact part 30A comes in contact with the external circumferential side contact part 40A. The contact member 10A is used in the region 100.

Since the belt-shaped member 20 has a long overall length L2 (see FIG. 4), even if the contact member 10A is pushed and contracted in the region 100, plastic deformation does not occur in the body part 20A so that deformation of the body part 20 is maintained as the elastic deformation, and the contact member 10A has good spring properties.

Hypothetically if the internal circumferential side contact part 30A and the external circumferential side contact part 40A are connected to each other by a straight belt-shaped part, since the overall length of the belt-shaped part is relatively short, when the contact member is pushed and contracted in the region 100, the belt-shaped part may be plastically deformed beyond its elastic limit. Thus, in this case, the spring properties are not good.

Hypothetically if the internal circumferential side contact part 30A and the external circumferential side contact part 40A are connected to each other by a straight belt-shaped part having a length of L1×L3, since the contact member is formed by spirally winding the belt-shaped part approximately three turns, the diameter of the contact member is large. Accordingly, it is difficult to arrange the contact member with a narrow pitch. Hence, this structure is not proper for a connector or a socket which requires arrangement of the contact members at high density.

On the other hand, in the first embodiment of the present invention, the belt-shaped part 20 includes U-shaped turning points 23 and 24. Accordingly, it is possible to obtain good spring properties without making the diameter of the contact member 10A large. Because of this, the contact member 10A comes in contact with and is pushed to contact an opponent member such as a pad or a solder ball with the repulsion force between f1 and f2, and it is possible to increase the reliability of the electrical connection between the contact member 10A and the opponent member.

Figure 6:
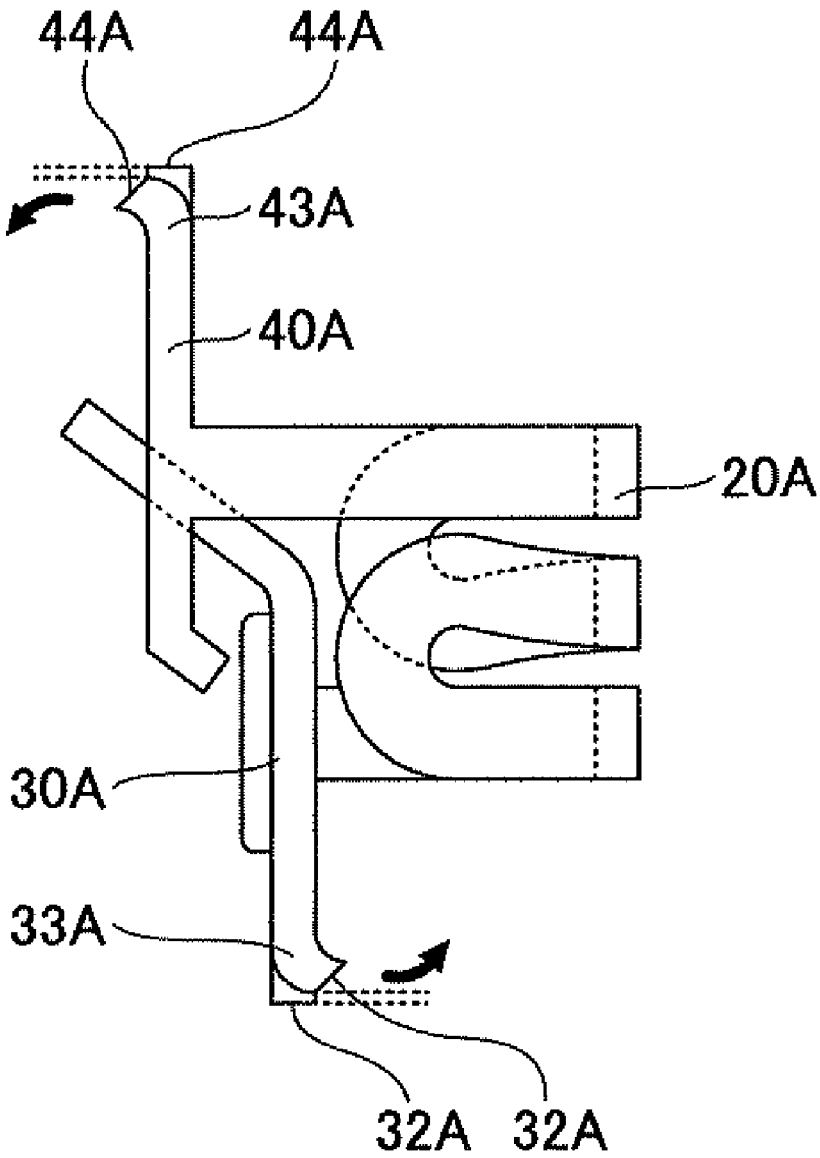
FIG. 6 is a view of deformed states of contact parts 33A and 43A.

In addition, in the first embodiment of the present invention, the bifurcated (Y-bent shaped) contact parts 33A and 43A which can be elastically deformed are provided at the axial direction end surfaces (Z2 side surface and Z1 side surface) at a side where the internal circumferential side contact part 30A and the external circumferential side contact part 40A, respectively, come in contact with the opponent member. Accordingly, as shown in FIG. 6, concavity and convexity of the opponent member such as the pad or the solder ball can be accommodated. Because of this, it is possible to increase the reliability of the electrical connection between the contact member 10A and the opponent member.

Furthermore, in the first embodiment of the present invention, when the contact member 10A is compressed in the axial direction, the internal circumferential side contact part 30A and the external circumferential side contact part 40A come in contact with each other. Therefore, the electrical signal is transmitted directly (in a linear state) from the external circumferential side contact part 40A via the internal circumferential side contact part 30A. Because of this, the inductance of the electrical signal transmission path is in the nanohenry (nH) order of magnitude.

In addition, in the first embodiment of the present invention, when the contact member 10A is compressed in the axial direction, the internal circumferential side contact part 30A and the external circumferential side contact part 40A come in linear contact with each other via the first and second projecting parts 36A and 46A. Accordingly, in the first embodiment of the present invention, compared to a case where the surface of the internal circumferential side contact part 30A and the surface of external circumferential side contact part 40A come in contact with each other not via the first and second projecting parts 36A and 46A, it is possible to improve the contact pressure. As a result of this, it is possible to improve the reliability of the electric connection between the internal circumferential side contact part 30A and the external circumferential side contact part 40A.

Figure 7:
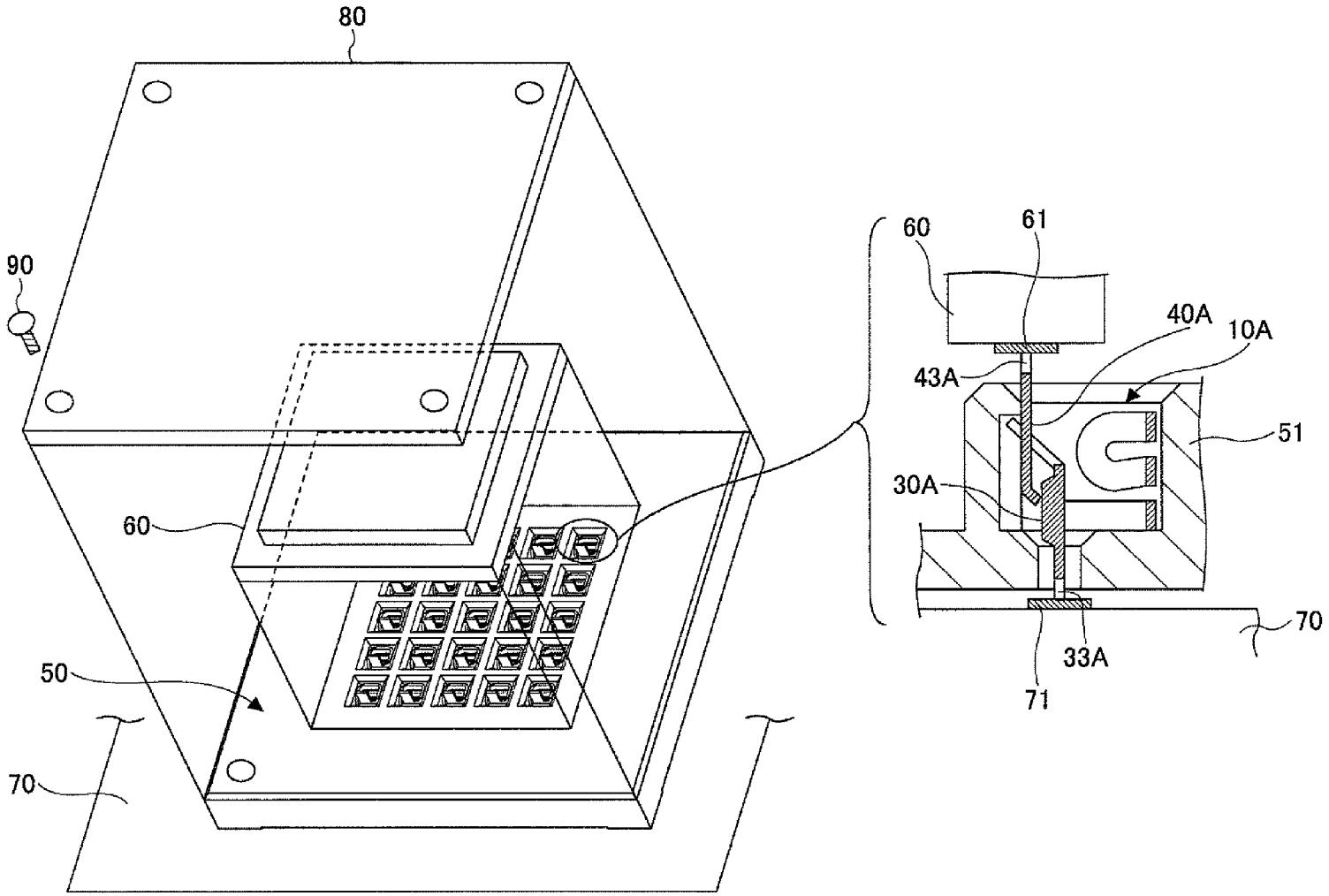
FIG. 7 is a perspective view of an LGA type IC package connector, an LGA type IC package, a printed circuit board, and a cover member.

The contact member 10A is used for, for example, a component forming an LGA type IC package contactor 50 shown in FIG. 7.

Here, FIG. 7 is a perspective view of an LGA type IC package connector, an LGA type IC package, a printed circuit board, and a cover member. FIG. 8(A) is a top view of the LGA type IC package connector 50. FIG. 8(B) is a side view of the LGA type IC package connector 50. FIG. 8(C) is a bottom view of the LGA type IC package connector 50. FIG. 9 is an expanded cross-sectional view taken along a line A-A of FIG. 8(A).

FIG. 10(A) is a top view of the connector main body 51. FIG. 10(B) is a side view of the connector main body 51. FIG. 10(C) is a bottom view of the connector main body 51. FIG. 11 is an expanded cross-sectional view taken along a line A-A of FIG. 10(A).

Figure 8:
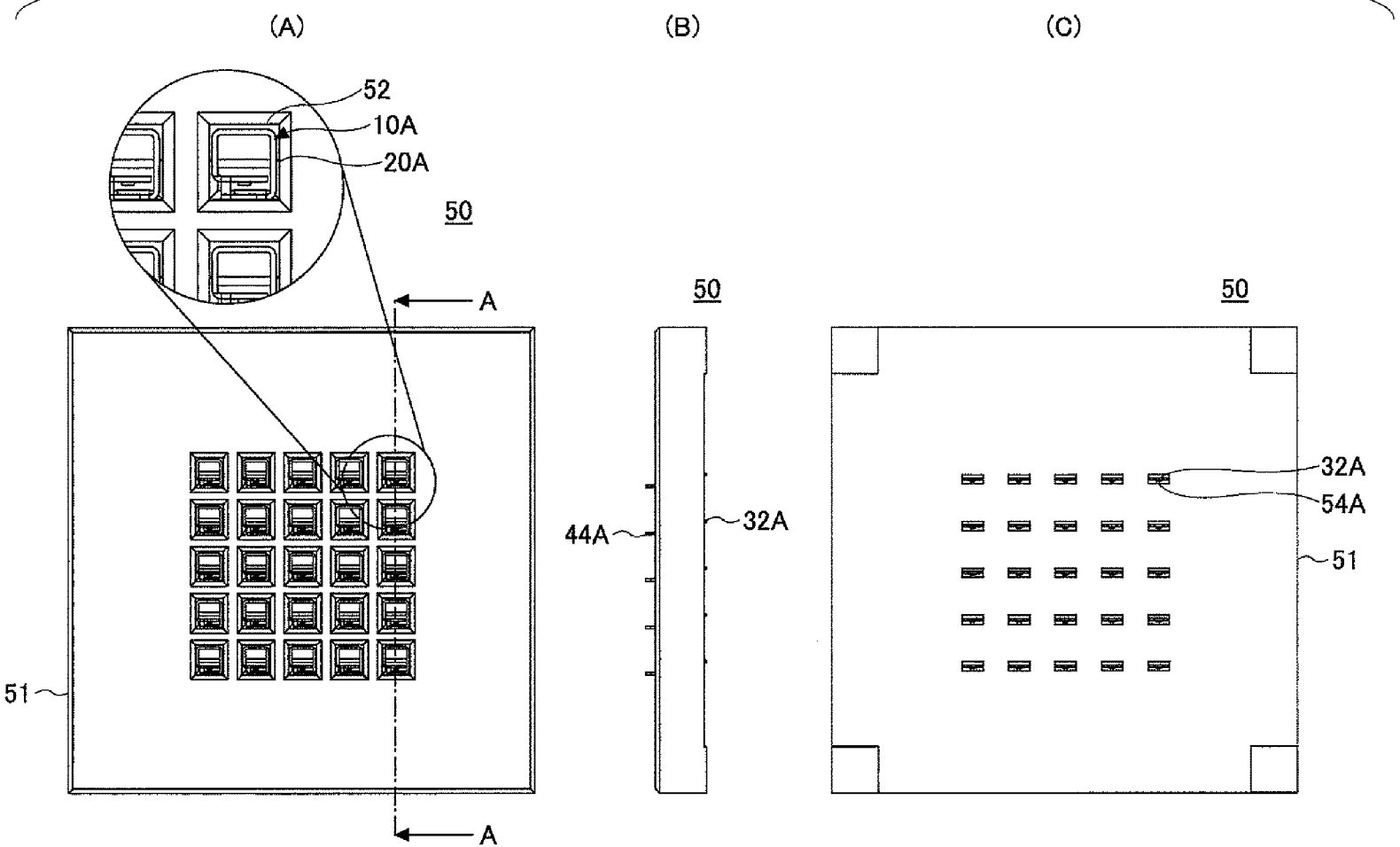
FIG. 8 is a view showing the LGA type IC package connector.
Figure 9:
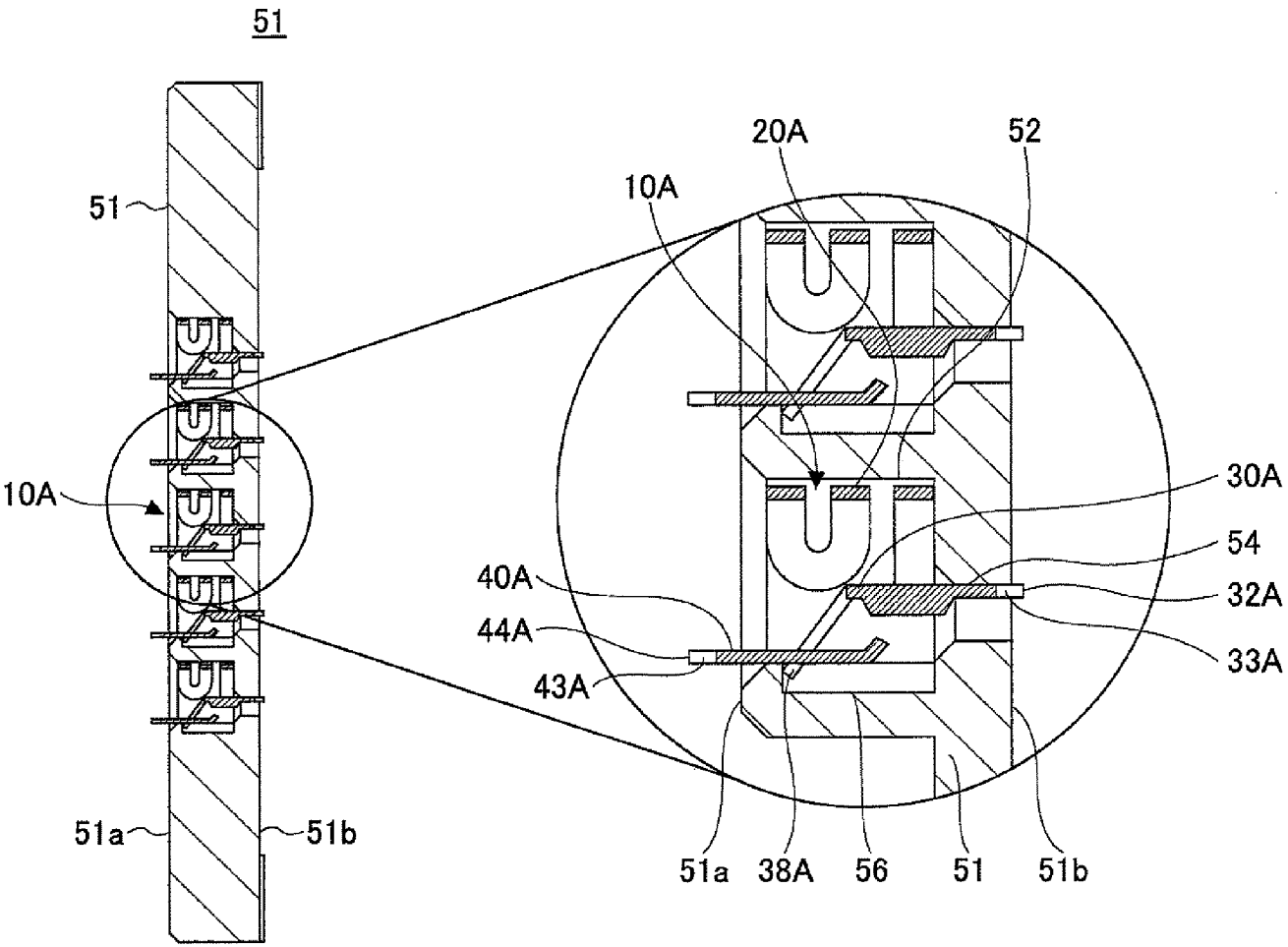
FIG. 9 is an expanded cross-sectional view taken along a line A-A of FIG. 8.

As shown in FIG. 7 through FIG. 9, the LGA type IC package connector 50 includes a connector main body 51 and the contact member 10A.

Figure 10:
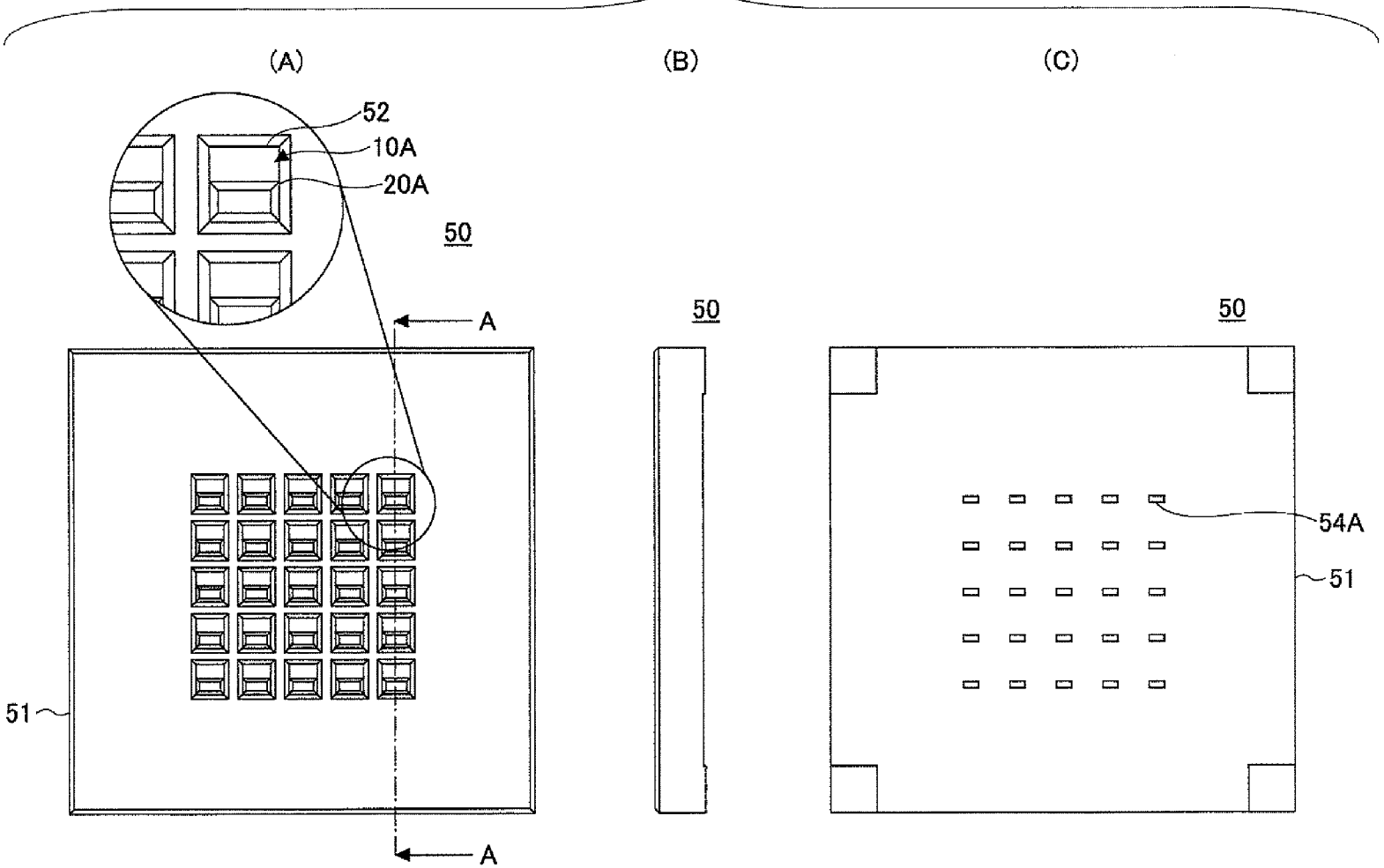
FIG. 10 is a view showing a connector main body 51.
Figure 11:
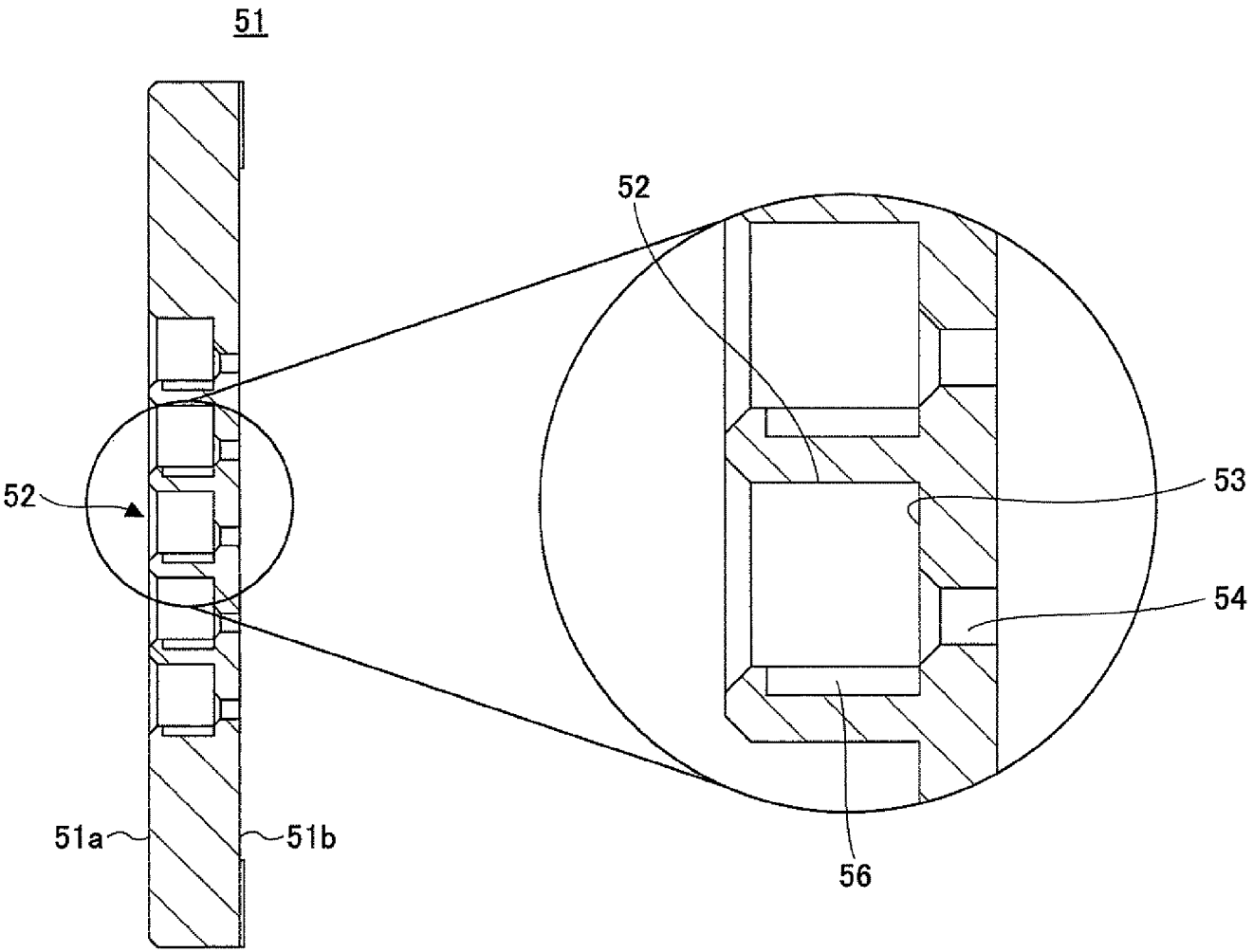
FIG. 11 is an expanded cross-sectional view taken along a line A-A of FIG. 10.
Figure 12:
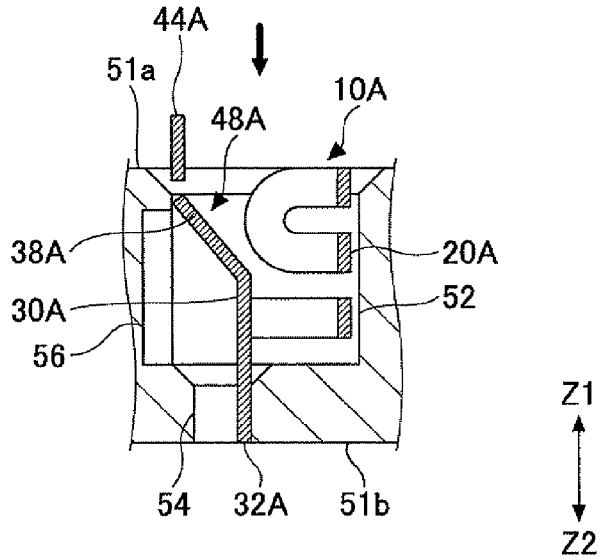
FIG. 12 is a cross-sectional view showing a time series of a method of providing the contact member 10A in the connector main body 51.
Figure 12:
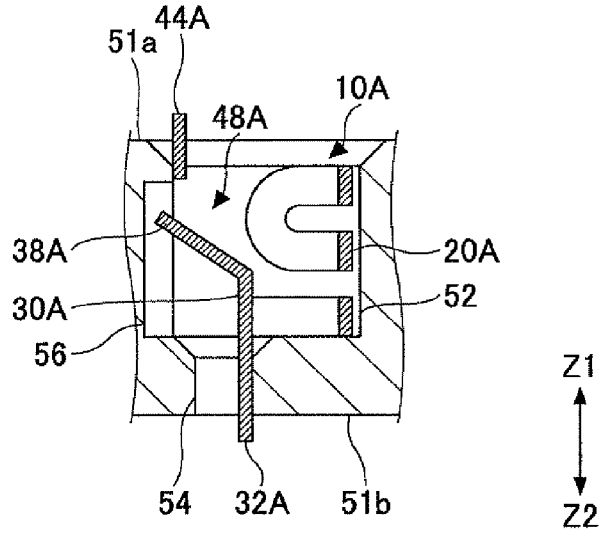

As shown in FIG. 10(A) through FIG. 11, the connector main body 51 has a plate-shaped configuration and insulation. Hole parts 52 corresponding to the body parts 20A of the contact members 10A are provided in a matrix manner in the connector main body 51. The hole part 52 does not pierce the connector main body 51 but has an internal bottom surface 53. A slit part 54 is provided at the internal bottom surface 53 of the hole part 52. The slit part 54 extends in the axial direction of the hole part 52. A groove part 56 is provided at the internal bottom surface 53 of the hole part 52. The groove part 56 extends in the axial direction of the hole part 52.

FIGS. 12(A) and 12(B) are cross-sectional views showing a time series of a method of providing the contact member 10A in the connector main body 51. After the internal circumferential side contact part 30A and the slit part 54 are positioned, the contact member 10A is inserted from the lower end 32A of the internal circumferential side contact part 30A into the hole part 52. By inserting the contact member 10A into the hole part 52, the projection part 38A comes in contact with an entrance edge of the hole part 52.

In this position, when the contact member 10A is pressed in the inserting direction (Z2 direction), as shown in FIG. 12(A), the projection part is pressed to the internal circumferential side and is elastically bent so as to pass through the entrance edge of the hole part 52.

When the projection part 38A reaches the position of the groove part 56, pressing is relieved. Therefore, as shown in FIG. 12(B), the projection part 38A is elastically restored so as to be supported movably in the axial direction (Z1-Z2 directions) in the groove part 56. As a result of this, the body part 20A is supported in the hole part 52 movably in the axial direction and the internal circumferential side contact part 30A is supported in the slit part 54 movably in the axial direction. Thus, the contact member 10A is provided in the connector main body 51.

In this assembled state, due to a step between the groove part 56 and the hole part 52, movement of the projection part 38A to a side opposite to the inserting direction is prevented. As a result of this, it is possible to prevent the contact member 10 from dropping from the connector main body 51.

The lower end 32A of the internal circumferential side contact part 30A projects from the lower surface 51*b* of the connector main body 51. The upper end 44A of the external circumferential side contact part 40A projects from the upper surface 51*a* of the connector main body 51.

In the LGA type IC package contactor 50, the lower end 32A of the internal circumferential side contact part 30A projects to the lower surface 51*b*. The upper end 44A of the external circumferential side contact part 40A projects to the upper surface 51*a*. The contact members 10A are provided in the LGA type IC package contactor 50 in the matrix manner.

Such an LGA type IC package contactor 50 is used as shown in FIG. 7. The LGA type IC package contactor 50 is provided on a printed circuit board 70. An LGA type IC package 60 is mounted on the LGA type IC package contactor 50. The cover member 80 is mounted on the LGA type IC package 60 and screw members 90 are provided so as to be screw-fixed with nuts (not shown in FIG. 7) at the rear surface side of the printed circuit board 70. As a result of this, the entirety is fixed on the printed circuit board 70 and the LGA type IC package 60 is mounted on the printed circuit board 70.

Each of the contact members 10A is pressed, so that the internal circumferential side contact part 30A and the external circumferential side contact part 40A come in contact with each other, the lower end 32A comes in contact with a pad 71 on the printed circuit board 70, and the upper-end 44A comes in contact with a pad 61 on the rear surface of the LGA type IC package 60. The contact member 10A forms a straight electrical signal transmission path by the internal circumferential side contact part 30A and the external circumferential side contact part 40A coming in contact with each other. The inductance is in the nanohenry (nH) order of magnitude.

Second Embodiment

Figure 13:
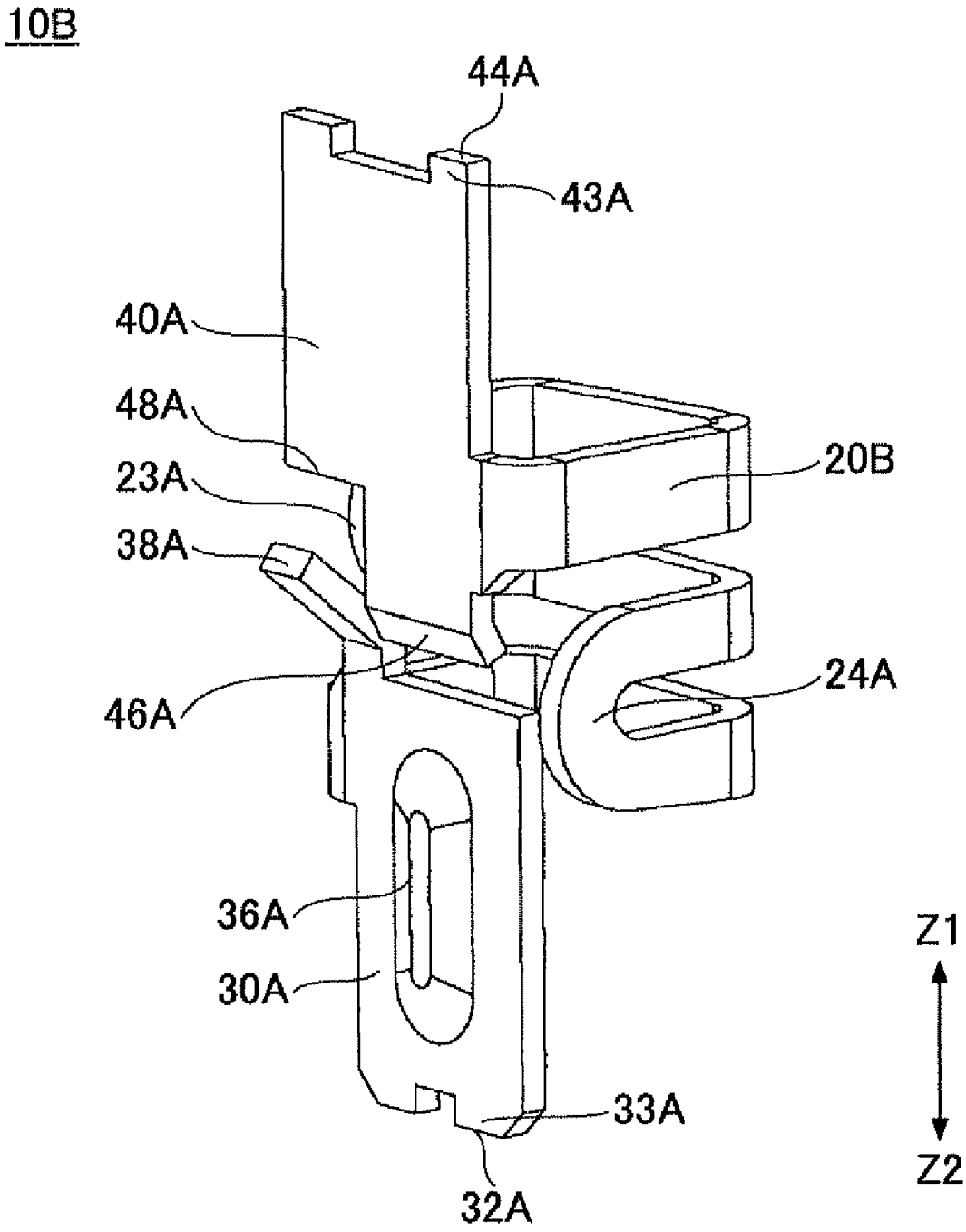
FIG. 13 is a perspective view showing a contact member of a second embodiment of the present invention.

FIG. 13 is a perspective view showing a contact member 10B of the second embodiment of the present invention.

The contact member 10B is different from the contact member 10A shown in FIG. 2(A) in that the internal circumferential side contact part 30A and the external circumferential side contact part 40A are provided with separation in the axial direction (Z1-Z2 directions) in the second embodiment. In other words, the dimension S1 (see FIG. 4) of the belt-shaped part which is the main body part 20B is greater in the second embodiment. Other than this, the second embodiment is the same as the first embodiment and therefore explanations of the same parts are omitted.

Since the internal circumferential side contact part 30A and the external circumferential side contact part 40A are provided with separation in the axial direction (Z1-Z2 directions), it is possible to apply a plating process to the contact member 10B. As a result of this, it is possible to improve conductivity of the contact member 10B.

Third Embodiment

Figure 14:
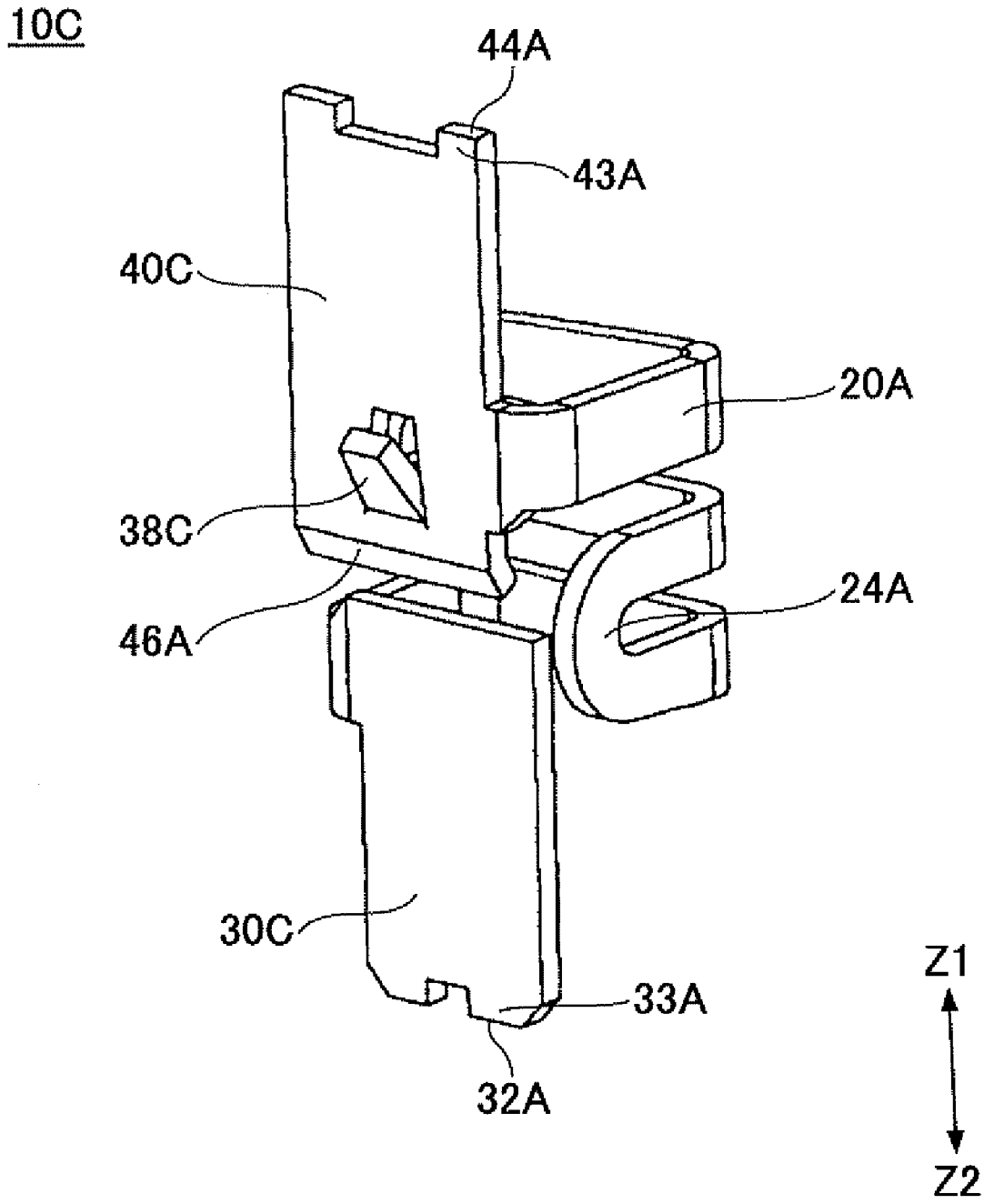
FIG. 14 is a perspective view showing a contact member of a third embodiment of the present invention.
Figure 15:
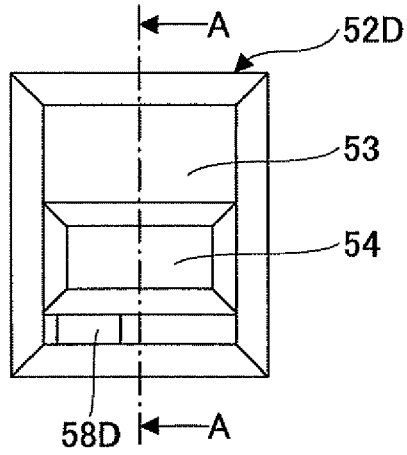
FIG. 15 is an expanded view showing a connector main body of a fourth embodiment of the present invention.
Figure 15:
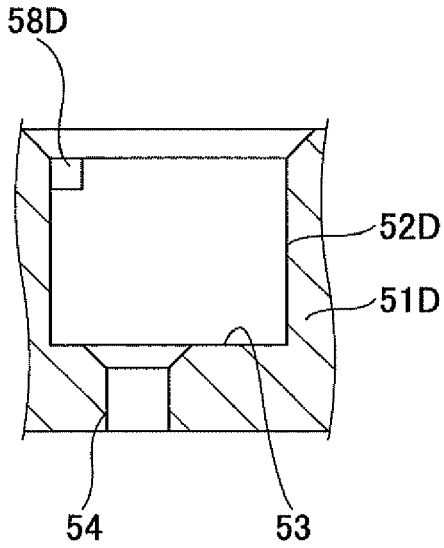

FIG. 14 is a perspective view showing a contact member 10C of the third embodiment of the present invention.

The contact member 10C of the third embodiment is different from the contact member 10A shown in FIG. 2 in that the second projecting part 36A is not provided in the contact member 10C.

When the contact member 10C is compressed in the axial direction, an internal circumferential side contact part 30C and an external circumferential side contact part 40C are come in contact with each other linearly via the first projecting part 46A. Therefore, it is possible to improve contact pressure in this embodiment compared to a case where a surface of the internal circumferential side contact part 30C and a surface of the external circumferential side contact part 40C come in contact with each other not via the first projecting part 46A. Because of this, it is possible to improve the reliability of the electrical connection between the internal circumferential side contact part 30C and the external circumferential side contact part 40C.

The contact member 10C of this embodiment is different from the contact member 10A of FIG. 2 in the point of a projection part 38C. The projection part 38C is formed so as to project to the external circumferential surface of the external circumferential side contact part 40C in the Z1 direction.

The projection part 38C is formed by, for example, cutting a part of the external circumferential side contact part 40C. When the projection part 38C is pressed, the projection part 38C is elastically bent. In this case, the notch part 48A shown in FIG. 2 is not necessary.

The projection part 38A shown in FIG. 2, unlike the projection part 38C shown in FIG. 14, is formed on the external circumferential surface of the internal circumferential side contact part 30A. Therefore, the length of the projection part 38A is relatively long and therefore can be easily bent when being pressed. Therefore, it is possible to easily provide the projection part 38A in the groove part 56.

Fourth Embodiment

FIGS. 15(A) and 15(B) are expanded views showing a connector main body of the fourth embodiment of the present invention. FIG. 15(A) is a top view corresponding to FIG. 10(A). FIG. 15(B) is a cross section taken along a line A-A of FIG. 10(A).

In a connector main body 51D, hole parts 52D which correspond to the body parts 20A of the contact members 10A shown in FIG. 2 are provided in a matrix manner. The hole part 52D does not pierce the connector main body 51D and includes an internal bottom surface 53. A slit part 54 is formed at the internal bottom surface 53 of the hole part 52D. The slit part 54 extends in the axial direction of the hole part 52D. A convex part 58D is provided on the internal wall surface of the hole part 52D.

Figure 16:
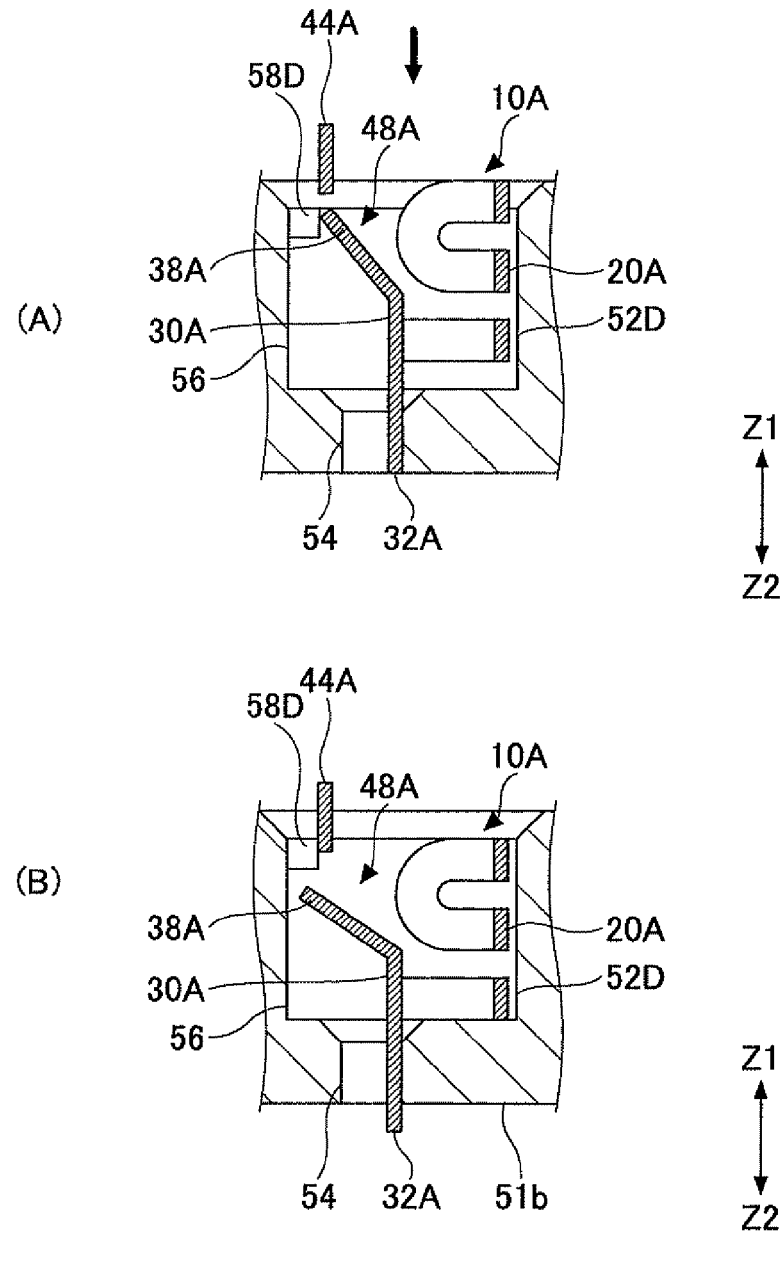
FIG. 16 is a cross-sectional view showing a time series of a method of providing the contact member 10A in a connector main body 51D.

FIGS. 16(*a*) and 16(B) are cross-sectional views showing in time series a method of providing the contact member 10A in the connector main body 51D.

After the internal circumferential side contact part 30A and the slit part 54 are positioned, the contact member 10A is inserted from the lower end 32A of the internal circumferential side contact part 30A into the hole part 52D. By inserting the contact member 10A into the hole part 52D, the projection part 38A comes in contact with a convex part 58D.

In this position, when the contact member 10A is pressed in the inserting direction (Z2 direction), as shown in FIG. 16(A), the projection part 38A is pressed to the internal circumferential side and is elastically bent so as to pass by the convex part 58D.

During a time period when the head end part of the projection part 38A passes by the convex part 58D, the projection part 38A is bent to a most internal circumferential side. When the projection part 38A reaches the convex part 58D, pressing is ceased. Therefore, as shown in FIG. 16(B), the projection part 38A is elastically restored so as to be supported by the hole part 52D movably in the axial direction (Z1-Z2 directions). As a result of this, the body part 20A is supported in the hole part 52D movably in the axial direction and the internal circumferential side contact part 30A is supported in the slit part 54 movably in the axial direction. Thus, the contact member 10A is provided in the connector main body 51D.

In this inserted state, movement of the projection part 38A to a side opposite to the inserting direction is prevented by the convex part 58D. As a result of this, it is possible to prevent the contact member 10A from dropping from the connector main body 51D.

The present invention is not limited to these embodiments, but variations and modifications may be made without departing from the scope of the present invention.

For example, in the contact member 10A (10B, 10C) of the above-discussed embodiments, the internal circumferential side contact part 30A (30C) and the external circumferential side contact part 40A (40C) are shifted in the axial direction, and the internal circumferential side contact part 30A (30C) is shifted to the Z2 side and the external circumferential side contact part 40A (40C) is shifted to the Z1 side. However, the present invention is not limited to this.

For example, the internal circumferential side contact part 30A (30C) may be shifted to the Z1 side and the external circumferential side contact part 40A (40C) may be shifted to the Z2 side.

Furthermore, in the above-discussed embodiments, the contact member 10A (10B, 10C) has a substantially rectangular pole-shaped configuration. However, the present invention is not limited to this.

For example, the contact member 10A (10B, 10C) may have a cylindrical-shaped configuration. There is no limitation to configurations of the body part 20A (20B) and others.

In addition, in the contact member 10A (10B, 10C) of the above-discussed embodiments, when the external force is not acting on the contact member 10A (10B, 10C), the gap 12A is formed between the internal circumferential side contact part 30A (30C) and the external circumferential side contact part 40A (40C). However, the present invention is not limited to this.

For example, the gap 12A may not be formed and the internal circumferential side contact part 30A (30C) and the external circumferential side contact part 40A (40C) may come in light contact with each other. In other words, when the contact member 10A (10B, 10C) is compressed in the axial direction, the body part 20A (20B) may be elastically deformed so that the internal circumferential side contact part 30A (30C) and the external circumferential side contact part 40A (40C) may come in contact with each other.

Furthermore, in the above-discussed embodiments, when the contact member 10A (10B, 10C) is compressed in the axial direction, the internal circumferential side contact part 30A (30C) and the external circumferential side contact part 40A (40C) come in linear contact with each other. However, the present invention is not limited to this.

For example, a point of the internal circumferential side contact part 30A (30C) and a point of the external circumferential side contact part 40A (40C) may come in contact with each other. In other words, when the contact member 10A (10B, 10C) is compressed in the axial direction, a structure may be applied whereby contact pressure can be improved as compared to a case where a surface of the internal circumferential side contact part 30A (30C) and a surface of the external circumferential side contact part 40A (40C) come in contact with each other.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

What is claimed is:

1. A contact member, comprising:

a body part formed by providing a belt-shaped part in a substantially ring shape;

an internal circumferential side contact part provided at one end of the body part and situated at an internal circumferential side of the contact member; and an external circumferential side contact part provided at another end of the body part and situated at an external circumferential side of the contact member;

wherein, in a case where the body part is compressed in an axial direction, the body part is elastically deformed so that the internal circumferential side contact part and the external circumferential side contact part come in contact with each other, the belt-shaped part includes a U-shaped turning point between the internal circumferential side contact part and the external circumferential side contact part; and one of the internal circumferential side contact part and the external circumferential side contact part includes a first projecting part, the first projecting part being configured to come in contact with the other of the internal circumferential side contact part and the external circumferential side contact part.

2. The contact member as claimed in claim 1, wherein the other of the internal circumferential side contact part and the external circumferential side contact part includes a second projecting part, the second projecting part being configured to come in contact with the first projecting part.

3. The contact member as claimed in claim 1, wherein at least one of the internal circumferential side contact part and the external circumferential side contact part includes a bifurcated contact part, the bifurcated contact part being capable of being elastically deformed.

4. The contact member as claimed in claim 1, wherein the internal circumferential side contact part and the external circumferential side contact part are provided with separation in an axial direction of the body part.

5. The contact member as claimed in claim 1, wherein the belt-shaped part has a S-shaped configuration.

6. A connector, comprising:

the contact member as claimed in claim 1; and a connector main body having a hole part corresponding to the body part, wherein the body part is movably supported by the hole part in an axial direction of the body part after the body part is inserted in the hole part.

7. The connector as claimed in claim 6, wherein a projection part is provided on an external circumferential surface of the internal circumferential side contact part or an external circumferential surface of the external circumferential side contact part;

the projection part is configured to project to a side opposite to a direction where the body part is inserted;

a groove part is provided at an internal wall surface of the hole part;

the groove part is configured to extend in an axial direction of the hole part;

the projection part is pressed by the internal wall surface of the hole part so as to be bent to the internal circumferential side when the body part is inserted in the hole part; and the projection part is elastically restored when the body part reaches a position of the groove part, so that the projection part is movably supported by the groove part in an axial direction of the main body.

8. The connector as claimed in claim 6, wherein a projection part is provided on an external circumferential surface of the internal circumferential side contact part or an external circumferential surface of the external circumferential side contact part;

the projection part is configured to project to a side opposite to a direction where the body part is inserted;

a convex part is provided at an internal wall surface of the hole part;

the projection part is pressed by the convex part so as to be bent to the internal circumferential side when the body part is inserted in the hole part; and the projection part is elastically restored when the body part passes through the convex part, so that the projection part is movably supported by the hole part in an axial direction of the main body.

9. The connector as claimed in claim 6, wherein the hole part includes an internal bottom surface;

a slit part is provided at the internal bottom surface, the slit part extends in an axial direction of the hole part; and the internal circumferential side contact part or the external circumferential side contact part is supported by the slit part in an axial direction of the body part after the body part is inserted in the hole part.

* * * * *